US010124467B2

(12) United States Patent
Nientiedt et al.

(10) Patent No.: US 10,124,467 B2
(45) Date of Patent: Nov. 13, 2018

(54) ABRASIVE SUPPORT, ABRASIVE ARTICLE COMPRISING THE ABRASIVE SUPPORT, AND METHOD FOR THE PRODUCTION THEREOF

(71) Applicant: NEENAH GESSNER GMBH, Bruckmuehl (DE)

(72) Inventors: Juergen Nientiedt, Grosskarolinenfeld (DE); Christine Doege, Bruckmuehl (DE); Peter Karl, Pullach (DE)

(73) Assignee: NEENAH GESSNER GMBH, Bruckmuehl (DE)

( * ) Notice: Subject to any disclaimer, the term of this patent is extended or adjusted under 35 U.S.C. 154(b) by 98 days.

(21) Appl. No.: 15/039,625

(22) PCT Filed: Nov. 18, 2014

(86) PCT No.: PCT/EP2014/075937
§ 371 (c)(1),
(2) Date: May 26, 2016

(87) PCT Pub. No.: WO2015/079021
PCT Pub. Date: Jun. 4, 2015

(65) Prior Publication Data

US 2017/0028530 A1 Feb. 2, 2017

(30) Foreign Application Priority Data

Nov. 29, 2013 (DE) ..... 10 2013 224 549

(51) Int. Cl.

| | |
|---|---|
| ***B24D 11/00*** | (2006.01) |
| ***B24D 18/00*** | (2006.01) |
| ***B24D 11/02*** | (2006.01) |
| ***B24D 3/34*** | (2006.01) |

(52) U.S. Cl.
CPC ..... *B24D 11/001* (2013.01); *B24D 3/348* (2013.01); *B24D 11/02* (2013.01); *B24D 18/0027* (2013.01)

(58) Field of Classification Search
CPC ..... B24D 11/00; B24D 11/02; B24D 11/001; B24D 18/00; B24D 3/34; B24D 3/348; B24D 18/0027
USPC .... 451/526, 527, 533–534, 536, 28; 51/297, 51/298
See application file for complete search history.

(56) References Cited

U.S. PATENT DOCUMENTS

| | | | | |
|---|---|---|---|---|
| 3,692,618 | A | 9/1972 | Dorschner et al. | |
| 3,802,817 | A | 4/1974 | Matsuki et al. | |
| 3,855,046 | A | 12/1974 | Hansen et al. | |
| 4,340,563 | A | 7/1982 | Appel et al. | |
| 4,386,943 | A | 6/1983 | Gumbel et al. | |
| 4,405,341 | A | 9/1983 | Jaschek et al. | |
| 6,998,166 | B2 * | 2/2006 | Prasad | B24B 37/24 428/141 |
| 2013/0111823 | A1 | 5/2013 | Klenner et al. | |

FOREIGN PATENT DOCUMENTS

| | | | |
|---|---|---|---|
| DE | 2928484 | B1 | 10/1980 |
| DE | 3218441 | C1 | 4/1983 |
| DE | 102010036554 | A1 | 1/2012 |
| WO | 97/05990 | A1 | 2/1997 |
| WO | WO 2005/110681 | A1 | 11/2005 |

OTHER PUBLICATIONS

International Search Report dated Feb. 12, 2015 issued in PCT/EP2014/075937.

* cited by examiner

*Primary Examiner* — Robert Rose
(74) *Attorney, Agent, or Firm* — Scully, Scott, Murphy and Presser P.C.

(57) ABSTRACT

The invention relates to an abrasive support, to an abrasive article comprising such a support, to the method for producing the same, and to the use of the abrasive article. According to at least one embodiment, the abrasive support comprises an impregnated support material based on synthetic fibers. The impregnated support material has at least on one side having a surface roughness $R_z$ of 100 μm to 500 μm, and having an $R_{max}$ of 250 μm to 600 μm. The support has an air permeability of at most 20 $l/m^2$ s.

21 Claims, No Drawings

ABRASIVE SUPPORT, ABRASIVE ARTICLE COMPRISING THE ABRASIVE SUPPORT, AND METHOD FOR THE PRODUCTION THEREOF

The invention relates to a support for abrasives, to an abrasive article comprising such a support, to the method for producing the same, and to the use of the abrasive article.

To meet the varied technical requirements of today, abrasive supports are needed that are tough and strong in order not to tear during abrading and in order to be able to effectively transmit the abrasive force to a workpiece. Furthermore, a high flexibility of the abrasive support is also desirable so that it can adjust to the contours of a workpiece without being permanently deformed.

For many years, fabric supports have been used for the production of abrasive articles in the shape of sheets, belts and disks, which often contain a fabric of natural fibers, such as cotton, and synthetic fibers. Although fabric supports have a better tear strength, shape stability, splitting strength and flexibility compared to the abrasive papers that were initially widely used in this field, the production of these fabric supports is very complex and thus often associated with very high production costs. Thus, fabric supports are disadvantageous from the economic perspective. In the application WO 2005/110681 A1 such a fabric support is described by way of example.

It has been attempted in the past to replace the fabric supports with nonwovens of synthetic fibers and/or glass fibers. In the application DE 10 2010 036554 A1, for instance, a spunbonded nonwoven is described which is impregnated with a thermally curable resin. In the cured state, the abrasive support is too stiff, however, to be able to serve as replacement for fabric supports, e.g. for abrasive belts.

Another important aspect in the production and the use of abrasive articles is the adhesion of the abrasive on the abrasive support. High mechanical and thermal loads during abrading, to which in particular abrasive belts are subjected, can lead to the abrasive detaching from the support. Particularly problematic in this regard is the abrading of edges and dot-shaped protrusions on the workpiece.

A possibility for improving the adhesion of the abrasive on a support is described in the application WO 97/005990 A1. There, in the production of an abrasive belt, the adhesion is improved by a "primer" which is also understood, inter alia, as mechanical roughening, e.g. by grinding, of the surface of the support. However, mechanical roughening has the disadvantage that the surface of the support is opened up and damaged so that a subsequently applied binder for the abrasive can penetrate into the support. The binder can subsequently lead to embrittlement of the support, and thus have a negative influence on the flexibility thereof. Moreover, mechanical roughening represents an additional working step.

In the European application EP 0 024 511 A1, the improvement of the binder adhesion for the abrasive is achieved by two effects combined with each other. Firstly, the surface of the fibers of the abrasive support is roughened by adding suitable chemicals to the coating agent. By using resins that provide a rough surface upon drying, the contact with the binder of the abrasive is additionally improved. However, the disadvantage of this method is that the chemicals used for fiber roughening—for instance sodium hydroxide solution is suggested for polyester fibers—chemically degrade many conventional coating and binder resins. Thus, the durability of the abrasive article is in turn reduced.

Moreover, one is limited to the use of plastics for impregnation, which form a rough surface upon drying, but are as a rule expensive.

It is therefore an object of the present invention to provide an improved support for abrasives, which overcomes in particular the disadvantages of conventional abrasive supports. Such a support for abrasives should preferably have high flexibility, tear strength, shape stability, splitting strength, elasticity, tensile strength and abrasive adhesion and be cost-efficient in production. Further objects of the invention are to provide an abrasive article comprising such a support for abrasives, a method for producing such a support for abrasives and the corresponding abrasive article as well as a use of the abrasive article.

At least one of these objects is solved by the subject matter of the independent patent claims. The subclaims specify advantageous embodiments.

A support for abrasives is provided. Throughout the application, this can also be designated as "abrasive support" or briefly as "support".

According to at least one embodiment, a support for abrasives comprises an impregnated support material based on synthetic fibers, wherein the impregnated support material has at least one side having a surface roughness $R_z$ of 100 μm to 500 μm and having an $R_{max}$ of 250 μm to 600 μm, and the support has an air permeability of at most 20 $l/m^2$ s.

At the same time, the support advantageously has high flexibility and elasticity, high strength (tear strength, shape stability, splitting strength and tensile strength), and moreover enables good adhesion of binders and/or abrasives so that the support can be used for the production of a very durable, resilient and very easy-to-handle abrasive article.

In particular the high flexibility and strength of the support can, according to the inventors' assessment, be attributed to the fact that the support comprises a support material based on synthetic fibers and is very compact. A parameter for compactness, as stated above, is the air permeability that is determined pursuant to DIN EN ISO 9237:1995, as described in the test methods. The support has a low air permeability of at most 20 $l/m^2$ s, in particular at most 10 $l/m^2$ s and preferably at most 5 $l/m^2$ s. This high compactness of the support can be achieved in that the support material has been compacted. Thus, the support according to the invention preferably comprises a compacted support material.

Another advantage of the high compactness, which manifests itself in a low air permeability, is that the impregnated support material has hardly any pores or no pores at all into which a binder for the fixation of abrasives, e.g. a base lacquer, can penetrate. These binders are often hard and brittle and can lead to embrittlement in conventional supports. This can be largely avoided with the support according to the invention so that this support shows high durability as well as high flexibility.

The support enables a good adhesion of binders, e.g. a base lacquer as described in more detail below, and accordingly also of abrasives. The inventors have surprisingly found that good adhesion is enabled in particular by the particular surface roughness of the impregnated support material $R_z$ of 100 μm to 500 μm with an $R_{max}$ of 250 μm to 600 μm. The surface roughness is determined pursuant to DIN EN ISO 4288:1997, as described in detail below with regard to the test methods. $R_z$ is the arithmetic mean of the individual depths of roughness of all 5 individual measurement lengths; $R_{max}$ refers to the greatest of the five individual depths of roughness. $R_z$ can preferably be greater than 150 μm and $R_{max}$ can range from 250 μm to 450 μm. With a lower surface roughness, the above-stated adhesion is worse than in the support according to the invention. If the surface roughness of the impregnated support material on the abrasive-supporting side is too large, an abrasive article with a too uneven abrasive surface is obtained. This can lead to an irregular abrasive result.

The surface roughness can be obtained in that at least one side of the impregnated support material, in contrast to numerous conventional support materials, is specifically provided therewith, for instance by means of structuring. In this regard, it is to be noted that the support and thus also the impregnated support material or only the support material is preferably configured areally—in a planar or also curved manner. The support, the impregnated support material and/or the support material thus have two sides. These correspond to the largest pair of opposite sides. They can also be understood as "main sides". Furthermore, it is to be noted that the above-stated surface roughness relates to the impregnated support material. Optional layers arranged thereon, for instance a barrier coating, can in turn change the roughness of the support surface.

In the impregnated support material, at least one side has a surface roughness $R_z$ of 100 μm to 500 μm with an $R_{max}$ of 250 μm to 600 μm. Even both sides can have such a surface roughness. However, the other side can also be configured smoothly. It can also have a lower or higher surface roughness.

The impregnated support material of the support according to the invention is based on synthetic fibers. Thus, it comprises a support material based on synthetic fibers, which has been impregnated with at least one impregnating agent.

"Based on synthetic fibers" is supposed to mean that the support material comprises at least 80% by weight, in particular at least 90% by weight and preferably at least 95% by weight of synthetic fibers or completely consists thereof. In particular, it comprises less than 10% by weight of natural fibers and preferably no natural fibers at all. The synthetic fibers are preferably organic polymers which are easier and cheaper to process than inorganic polymers, e.g. glass fibers, and result in a more flexible support.

According to a further embodiment, the synthetic fibers comprise synthetic continuous fibers or consist thereof. The expression "continuous fibers" as such is known to the person skilled in the art. As a rule, they have a length of at least 50 mm, in particular at least 80 mm. The fiber diameter is preferably 0.5 μm to 60 μm. Depending on the use, thinner fibers with a diameter of 0.5 μm to 10 μm, in particular 0.5 μm to 3 μm, or thicker fibers with a diameter of 10 μm to 60 μm, in particular 10 μm to 25 μm, can be used.

According to a further embodiment, at least 95% by weight, in particular at least 99% by weight, of the support material is not woven or the support material is not woven at all. The support material is preferably not woven, i.e. "unwoven", and thus differs from a fabric support. The fibers of the support material are preferably laid so that this corresponds to a laid scrim, for instance a nonwoven. The support according to the invention is preferably not a fabric support. According to a further development of this embodiment, the support material is a nonwoven. In particular, it can be a compacted nonwoven comprising or consisting of the above-described continuous fibers. These are easier and cheaper to produce than fabric supports. Such a nonwoven can be obtained, for instance, by a melt-blown or spunbonded nonwoven method.

According to a further embodiment, the support material is evenly soaked with an impregnating agent. This can be performed, for instance, by dip impregnation.

According to a further embodiment, the support material is impregnated with an impregnating agent on at least one side. For instance, it can be impregnated from one or also from both sides. If it is impregnated on both sides, the support material can be evenly soaked with the impregnating agent.

The impregnated support material can have a surface roughness $R_z$ of 100 μm to 500 μm with an $R_{max}$ of 250 μm to 600 μm on one side or on both sides, optionally irrespective of each other. This roughness can have been produced by structuring so that the corresponding side is structured.

According to a further embodiment, the surface roughness $R_z$ of 100 μm to 500 μm with an $R_{max}$ of 250 μm to 600 μm of the at least one side of the impregnated support material has been produced by calendering, in particular thermocalendering, with at least one structured roller. For instance, an embossing and/or engraving roller can be used as a structured roller. The inventors have found that by treating the support material by means of calendering several advantageous properties can be enabled in one working step, whereby the production of the support becomes very economic. If one side of the impregnated support material has the surface roughness $R_z$ of 100 μm to 500 μm with an $R_{max}$ of 250 μm to 600 μm, and the other side has a surface roughness outside of this range, the latter can also have been produced in the same calendering step.

By comparison with using exclusively smooth calendering rollers, the above-described surface roughness in the impregnated support material can be produced by the at least one structured roller. This roughness remains even after impregnation and leads to a better adhesion of a base lacquer and/or an abrasive. In contrast to conventional structuring methods, which include mechanical roughening, e.g. grinding, of a support, the surface and the fibers of the support material are not "damaged" according to this embodiment. Thus, the durability of the support is improved and a penetration of binders into the support material is largely prevented, which results in the above-described advantages. The use of chemicals for fiber roughening can also be advantageously omitted.

Furthermore, calendering also results in compacting of the support material. The desired degree of compaction can also be controlled by pressure and temperature during calendering, as described below. Preferably, the proportion of the compacted surface in the support material is 5% to 35%, in particular 10% to 30%. It can be 15% to 28%, in particular 20% to 27%.

According to a further embodiment, the synthetic fibers and/or continuous fibers comprise a polymer material selected from a group comprising polyethylene terephthalate, polybutylene terephthalate, polyethylene naphthalate, polybutylene naphthalate, polyamide, polyphenylene sulphide, polyolefin, polycarbonate, and combinations thereof. The fibers can also consist of the polymer material. In this regard, the synthetic (continuous) fibers, e.g. melt-blown as well as spunbonded nonwoven fibers, can consist of only one polymer, so-called mono-component fibers, and/or of several polymers, so-called multi-component fibers. The polymers of the multi-component fibers correspond to one of the above-stated combinations. Combinations can also be obtained by different mono-component fibers.

In multi-component fibers, there can be different arrangements of the polymers in the individual fibers, such as a "side-by-side" arrangement (the fiber cross-section brings to mind a cake cut in the middle, in which each half consists of a different polymer), a "segment arrangement" (the fiber cross-section brings to mind a cake cut into several pieces and the cake pieces consist, in particular alternately, of the different polymers), a so-called "island-in-the-sea" arrangement (the fiber cross-section brings to mind several islands of polymers surrounded by a sea of a different polymer) and/or of a "core-mantle" arrangement (the core consists of a fiber of a first polymer and is surrounded by a mantle of a second polymer).

Preferably, nonwovens, if they comprise multi-component fibers or consist thereof, were also subjected to high-pressure water jet treatment after formation of the nonwoven, by which treatment the individual fiber components are separated into a plurality of thin single fibers.

Depending on the requirements, the surface of melt-blown nonwovens or spunbonded nonwovens can be changed in its properties, e.g. wettability by water or reduced electrostatic charge, by surface treatment methods such as corona treatment or plasma treatment.

According to a further embodiment, the impregnating agent comprises a resin with a weight-average molecular weight of at least 50000 g/mol, in particular at least 100000 g/mol and preferably at least 250000 g/mol. The weight-average molecular weight of the resin can further be preferably at least 500000 g/mol and particularly preferably at least 1000000 g/mol. It can also consist of one or more of such resins. The inventors have surprisingly found that the resins used as impregnating agents with such a weight-average molecular weight close the pores of the support material and/or the nonwoven particularly well, and thus contribute to the impermeability of the impregnated support material. Impregnating agents consisting of a resin with a weight-average molecular weight of less than 50000 g/mol can surround fibers and connect these with each other, but are unable to bridge the hollow spaces between the fibers sufficiently well or to close these so that binders can penetrate which is not desired.

The impregnating agent amount is between 5% by weight and 70% by weight, preferably between 15% by weight and 60% by weight, of the dry impregnating agent, based on the weight of the non-impregnated support material.

According to a further embodiment, the impregnating agent is selected from a group comprising acrylic acid esters, polyvinyl acetate, acrylonitrile butadiene rubber, acrylic acid ester styrene copolymers, ethylene vinyl acetate copolymers, styrene butadiene rubber, phenolic resins, epoxy resins, natural rubber, polyvinyl alcohol, starch, melamine formaldehyde resin, urea formaldehyde resins, and combinations thereof. Preferably, these have the above-stated weight-average molecular weight and are present in the impregnated support material in corresponding proportions.

According to a further embodiment, a barrier coating layer is produced, in particular directly, on at least one side of the impregnated support material. This barrier coating can cover the side in part or entirely. The barrier coating or the barrier coating layer additionally seals the abrasive support, and thus prevents that a base lacquer applied later to produce an abrasive article can penetrate into the impregnated support material and lead to embrittlement of the support. The air permeability of a support with a barrier layer can be at most 10 $l/m^2$ s, in particular at most 5 $l/m^2$ s. Moreover, the barrier coating can act as a bonding agent between the impregnated support material and a base lacquer.

The barrier coating can comprise or consist of a material selected from a group comprising acrylic acid esters, polyvinyl acetate, acrylonitrile butadiene rubber, acrylic acid ester styrene copolymers, ethylene vinyl acetate copolymers, styrene butadiene rubber, phenolic resin, epoxy resin, natural rubber, and combinations thereof. The dry barrier coating can be produced to an amount of 5 to 40 $g/m^2$, preferably 5 to 30 $g/m^2$.

According to a further embodiment, the barrier coating layer is arranged on one side of the impregnated support material, which has a surface roughness $R_z$ of 100 to 500 μm and has an $R_{max}$ of 250 μm to 600 μm. As described above, within the scope of the application, a barrier coating is not considered to be part of the impregnated support material. The surface roughness of the support on the side of the barrier coating layer, which faces away from the impregnated support material, can deviate from the surface roughness of the impregnated support material.

According to a further embodiment, the support has a surface roughness $R_z$ of 20 μm to 300 μm and an $R_{max}$ of 50 μm to 400 μm on the side of the barrier coating layer, which faces away from the impregnated support material. $R_z$ is preferably 20 μm to 250 μm and $R_{max}$ 50 μm to 300 μm. With this surface roughness and due to the bonding properties of the barrier coating, a good adhesion of a base lacquer and/or an abrasive is also enabled.

Furthermore, various additives and/or fillers can also have been added to the impregnating agent and/or the barrier coating. Examples of such additives are dyes, cross-linking agents, hydrophobizing agents, oleophobizing agents, hydrophilizing agents, or combinations thereof. For instance, kaolin, titanium dioxide, talc, calcium carbonate, silicon dioxide, bentonite, or combinations thereof can be used as fillers.

A preferred support can have a grammage of more than 105 $g/m^2$, in particular in the range from 110 to 1870 $g/m^2$ and preferably from 115 to 1760 $g/m^2$. For instance, it can have a thickness of 0.100 to 2.500 mm, in particular 0.110 to 2.400 mm. The elasticity modulus in the longitudinal and transverse directions can be 100 to 10000 MPa. The support can have a tensile stiffness index of 0.3 to 10 MNm/kg in the longitudinal direction and of 0.2 to 10 MNm/kg in the transverse direction.

A preferred support can comprise, for instance, a nonwoven, compacted by thermocalendering, of synthetic continuous fibers, which is impregnated with one of the above-stated impregnating agents to an amount of between 5% by weight and 70% by weight, preferably between 15% by weight and 60% by weight, based on the weight of the non-impregnated nonwoven. During calendering, at least one side of the impregnated nonwoven can have been structured. A barrier coating layer of the above materials can be produced thereon.

For instance, such a support without a barrier coating layer has a grammage of 105 to 1870 $g/m^2$, preferably of 115 to 1760 $g/m^2$; a thickness of 0.100 to 2.500 mm, preferably of 0.110 to 2.400 mm; an air permeability of at most 20 $l/m^2$ s, preferably of at most 10 $l/m^2$ s; a breaking strength in dry condition and longitudinal direction of 10 to 1500 N/15 mm, preferably of 15 to 1300 N/15 mm; a breaking strength in dry condition and transverse direction of 5 to 1300 N/15 mm, preferably of 10 to 1200 N/15 mm; an elongation at break in dry condition and longitudinal direction of 10% to 60%, preferably of 12% to 55%; an elongation at break in dry condition and transverse direction of 15% to 65%, preferably of 18% to 60%; a bending stiffness in the longitudinal direction of 0.2 to 15.0 Nmm, preferably of 0.3 to 14.5 Nmm; a bending stiffness in the transverse direction of 0.1 to 14.0 Nmm, preferably of 0.2 to 13.5 Nmm; a tensile stiffness index in the longitudinal direction of 0.3 to 10.0

MNm/kg, preferably of 0.4 to 9.5 MNm/kg; a tensile stiffness index in the transverse direction of 0.2 to 10.0 MNm/kg, preferably of 0.3 to 9.5 MNm/kg; an elasticity modulus in the longitudinal direction of 100 to 10000 MPa, preferably of 150 to 9500 MPa; an elasticity modulus in the transverse direction of 100 to 10000 MPa, preferably of 150 to 9500 MPa; on at least one side a surface roughness $R_z$ of 100 to 500 μm and an $R_{max}$ of 250 to 600 μm, preferably an $R_z$ of 150 to 500 μm and an $R_{max}$ of 250 to 450 μm.

Such a support without a barrier coating layer can, in particular, have a grammage of 115 to 1760 g/m$^2$, a thickness of 0.110 to 2.400 mm, an air permeability of at most 10 l/m$^2$ s, a breaking strength in dry condition and longitudinal direction of 15 to 1300 N/15 mm; a breaking strength in dry condition and transverse direction of 10 to 1200 N/15 mm, an elongation at break in dry condition and longitudinal direction of 12% to 55%, an elongation at break in dry condition and transverse direction of 18 to 60%, a bending stiffness in the longitudinal direction of 0.3 to 14.5 Nmm, a bending stiffness in the transverse direction of 0.2 to 13.5 Nmm, a tensile stiffness index in the longitudinal direction of 0.4 to 9.5 Mnm/kg, a tensile stiffness index in the transverse direction of 0.3 to 9.5 MNm/kg, an elasticity modulus in the longitudinal direction of 150 to 9500 MPa, an elasticity modulus in the transverse direction of 150 to 9500 MPa, on at least one side a surface roughness $R_z$ of 150 to 500 μm and an $R_{max}$ of 250 to 450 μm.

For instance, such a support with a barrier coating layer has a grammage of 110 to 1900 g/m$^2$, preferably of 155 to 1570 g/m$^2$; a thickness of 0.100 to 2.500 mm, preferably of 0.110 to 2.500 mm; an air permeability of at most 10 l/m$^2$, preferably of at most 5 l/m$^2$; a breaking strength in dry condition and longitudinal direction of 10 to 1600 N/15 mm, preferably of 15 to 1500 N/15 mm; a breaking strength in dry condition and transverse direction of 5 to 1400 N/15 mm, preferably of 10 to 1500 N/15 mm; an elongation at break in dry condition and longitudinal direction of 10% to 70%, preferably of 12% to 60%; an elongation at break in dry condition and transverse direction of 10% to 75%, preferably of 15% to 70%; a bending stiffness in the longitudinal direction of 0.2 to 15.0 Nmm, preferably of 0.3 to 14.5 Nmm; a bending stiffness in the transverse direction of 0.1 to 14.0 Nmm, preferably of 0.2 to 13.5 Nmm; a tensile stiffness index in the longitudinal direction of 0.3 to 10.0 MNm/kg, preferably of 0.4 to 9.5 MNm/kg; a tensile stiffness index in the transverse direction of 0.2 to 10.0 MNm/kg, preferably of 0.3 to 9.5 MNm/kg; an elasticity modulus in the longitudinal direction of 100 to 10000 MPa, preferably of 150 to 9500 MPa; an elasticity modulus in the transverse direction of 100 to 10000 MPa, preferably of 150 to 10000 MPa; on the barrier-coated side a surface roughness $R_z$ of 20 to 300 μm and an $R_{max}$ of 50 to 400 μm, preferably an $R_z$ of 20 to 250 μm and an $R_{max}$ of 50 to 300 μm.

Such a support with a barrier coating layer can, in particular, have a grammage of 155 to 1570 g/m$^2$, a thickness of 0.110 to 2.500 mm, an air permeability of preferably at most 5 l/m$^2$, a breaking strength in dry condition and longitudinal direction of 15 to 1500 N/15 mm, a breaking strength in dry condition and transverse direction of 10 to 1500 N/15 mm, an elongation at break in dry condition and longitudinal direction of 12% to 60%, an elongation at break in dry condition and transverse direction of 15% to 70%, a bending stiffness in the longitudinal direction of 0.3 to 14.5 Nmm, a bending stiffness in the transverse direction of 0.2 to 13.5 Nmm, a tensile stiffness index in the longitudinal direction of 0.4 to 9.5 MNm/kg, a tensile stiffness index in the transverse direction of 0.3 to 9.5 MNm/kg, an elasticity modulus in the longitudinal direction of 150 to 9500 MPa, an elasticity modulus in the transverse direction of 150 to 10000 MPa, on the barrier-coated side a surface roughness $R_z$ of 20 to 250 μm and an $R_{max}$ of 50 to 300 μm.

As a further aspect of the invention, an abrasive article is provided. The abrasive article comprises a support according to at least one embodiment according to the invention.

According to at least one embodiment of the abrasive article, the support is sanded with an abrasive on one side of the impregnated support material, which has a surface roughness $R_z$ of 100 μm to 500 μm and has an $R_{max}$ of 250 μm to 600 μm. The expression "sanded" is known to the person skilled in the art, it means that abrasives are arranged and fixed on the impregnated support material.

The abrasive is not limited according to the invention. Basically, all materials can be used which can be applied to the support and which cause a removal of material from the workpiece during abrading. The abrasive can be selected, for instance, from a group comprising sand, diamond, corundum (aluminum oxide), silicon carbide, boron nitride, and combinations thereof. The abrasive is preferably present as particles, grains, grits or the like.

For sanding, the support is as a rule provided with a base lacquer. Then, the abrasive material is applied and thereafter a topcoat lacquer is produced. The abrasive article can thus comprise, arranged on the support, a base lacquer, abrasives as described above and a topcoat lacquer. A barrier layer, if provided, is as a rule arranged between the impregnated support material and the base lacquer.

The base lacquer may be selected, for example, from epoxy resin, phenolic resin, alkyd resin, urea resin, or combinations thereof. As a rule, a hard thermosetting resin, which additionally anchors the abrasive, is used as the topcoat lacquer. The topcoat lacquer may be selected, for example, from epoxy resin, phenolic resin, alkyd resin, urea resin, or combinations thereof.

According to a further embodiment of the abrasive article, a barrier coating layer is produced on the impregnated support material, and the support is sanded, in particular directly, on the side of the barrier coating layer, which faces away from the impregnated support material. As stated above, the barrier coating layer seals the support against a base lacquer and improves the adhesion thereof and/or the adhesion of the abrasive.

The abrasive article according to the invention is suited for both wet abrading and dry abrading. For instance, it can be configured as an abrasive belt, abrasive disk or abrasive sheet.

As a further aspect of the invention, the use of an abrasive article is therefore provided. An abrasive article according to at least one embodiment according to the invention can be used as an abrasive belt, abrasive disk or abrasive sheet and/or for the production thereof. According to the application, abrasive disks also include abrasive flap disks.

As a further aspect of the invention, a method is provided. With the method, a support for abrasives according to at least one embodiment according to the invention can be produced.

According to at least one embodiment, the method comprises the steps of (A) producing a support material based on synthetic fibers;

(B) calendering the support material with at least one structured roller so that the support material is structured on at least one side;

(C) impregnating the support material with an impregnating agent;

so that a support is obtained which comprises an impregnated support material based on synthetic fibers, which has at least one side having a surface roughness $R_z$ of 100 μm to 500 μm and having an $R_{max}$ of 250 μm to 600 μm, and which support has an air permeability of at most 20 $l/m^2$ s.

The method is preferably performed in this sequence of steps (A) to (C).

The support material corresponds to a support material according to at least one of the embodiments described above. Thus, it can be a nonwoven of synthetic continuous fibers, for example. The nonwoven can, e.g., be a so-called melt-blown nonwoven or a spunbonded nonwoven.

According to a further embodiment, the support material is produced in step (A) according to a melt-blown method or according to a spunbonded nonwoven method.

To produce a nonwoven for a support according to the invention, a so-called melt-blown process can be used. Such a process is described, for example, in the publication by A. van Wente, "Superfine Thermoplastic Fibers", Industrial Engineering Chemistry, vol. 48, pages 1342 to 1346, the disclosure of which is thus incorporated by reference.

Suitable polymers are selected, for example, from a group comprising polyethylene terephthalate, polybutylene terephthalate, polyethylene naphthalate, polybutylene naphthalate, polyamide, polyphenylene sulphide, polyolefin, polycarbonate, and combinations thereof. Typically, fiber diameters between 0.5 and 10 μm, preferably between 0.5 and 3 μm, can be obtained. Depending on the requirements, additives such as hydrophilizing agents, hydrophobizing agents, crystallization accelerators, dyes, and combinations thereof can be added to the polymers.

To produce a nonwoven for a support according to the invention, a so-called spunbonded nonwoven method can be used. Such a method is described, for example, in the applications U.S. Pat. No. 4,340,563 A, U.S. Pat. No. 3,802,817 A, U.S. Pat. No. 3,855,046 A and U.S. Pat. No. 3,692,618 A, the disclosures of which are thus incorporated by reference.

Polymers suitable for a spunbonded nonwoven method are selected, for example, from a group comprising polyethylene terephthalate, polybutylene terephthalate, polyethylene naphthalate, polybutylene naphthalate, polyamide, polyphenylene sulphide, polyolefin, polycarbonate, and combinations thereof. Typically, fiber diameters between 6 and 60 μm, preferably between 10 and 25 μm, can be obtained. Depending on the requirements, additives such as hydrophilizing agents, hydrophobizing agents, crystallization accelerators, dyes, or combinations thereof can be added to the polymers.

Both the (continuous) fibers produced according to the melt-blown method and those produced according to the spunbonded nonwoven method can consist of only one polymer (mono-component fibers) or of several polymers (multi-component fibers), as are described above.

Nonwovens of multi-component fibers can preferably be subjected to a high-pressure water jet treatment after the formation of the nonwoven, by which treatment the individual fiber components are separated into a plurality of thin single fibers.

Depending on the requirements, the surface of the support material or the nonwoven can be changed in its properties, e.g. wettability by water or reduced electrostatic charge, by a surface treatment method such as corona treatment or plasma treatment.

As mentioned above, it is advantageous for the flexibility and strength of the abrasive support according to the invention that the support material or the nonwoven is as compact as possible. To achieve this, it can be compacted, which can in particular be performed by the calendering in step (B).

According to a further embodiment, the calendering in step (B) is configured as thermocalendering. Thermocalenders required for this purpose are known per se to the person skilled in the art.

The properties of the support material can be set in step (B) e.g. through the line pressure (gap pressure) and the roller temperature. Compaction can be performed to such a degree that a predetermined, advantageously low air permeability is achieved, as described above. Calendering in step (B) can be performed, for example, at a gap pressure of 30 to 300 N/mm, preferably 50 to 300 N/mm, and at a temperature between 80° C. and 280° C., preferably between 100° C. and 260° C.

The inventors found that using exclusively smooth calendering rollers has a disadvantageous effect on the support. In addition to a desirable compaction, smooth calendering rollers also produce a smooth, in particular non-structured, surface of the support material to which a binder resin, a base lacquer, for the abrasive poorly adheres.

As described above, the inventors surprisingly found that the use of structured rollers, e.g. embossing or engraving rollers, considerably improves the adhesion of a binder resin on the support according to the invention. Structured rollers are used here that are designed so that they produce structures on at least one side of the support material, e.g. a nonwoven of synthetic continuous fibers. The support material is then in particular produced with a surface roughness $R_z$ of 100 to 500 μm and with an $R_{max}$ of 300 to 800 μm on at least one side.

The structured rollers used in step (B) can have all of the conventional patterns, in particular embossing or engraving patterns, such as lines, ovals, rhombuses (lozenges), truncated cones and/or ellipses. Corresponding patterns are then produced in the support material.

As mentioned above, the support material is preferably compacted in step (B). The proportion of the compacted surface can be 5% to 35%, preferably 10% to 30%, more preferably 15% to 28% and particularly preferably 20% to 27%.

In step (B), the support material for the abrasive support according to the invention can either be structured on only one side or on both sides.

The support material produced and calendered according to steps (A) and (B), preferably a nonwoven of synthetic (continuous) fibers, has e.g. a grammage of 100 to 1100 $g/m^2$; a thickness of 0.100 mm to 2.500 mm; an air permeability of at most 500 $l/m^2$ s, preferably of at most 200 $l/m^2$ s, and particularly preferably of at most 100 $l/m^2$ s; an elasticity modulus in the longitudinal direction of 150 to 13000 MPa and in the transverse direction of 100 to 11000 MPa; a tensile stiffness index in the longitudinal direction of 0.4 to 16.0 MNm/kg; a tensile stiffness index in the transverse direction of 0.2 to 16 MNm/kg and a surface roughness $R_z$ of 100 to 500 μm and an $R_{max}$ of 300 to 800 μm. These parameters, in particular the air permeability, can change when the support material is impregnated in step (C).

Following step (B), the support material is impregnated in step (C). By this, the impregnated support material of the support according to the invention is obtained. For the impregnation in step (C) e.g. size press, dip impregnation, foam impregnation, roller impregnation, or spraying, in particular dip impregnation, are suitable impregnating methods. The support material, in particular a nonwoven of continuous fibers, can be completely soaked with the impregnating agent by dip impregnation, for example. Thus, in particular, an even distribution of the impregnating agent is achieved. An impregnating agent can be applied to one side or both sides e.g. by roller, spray or foam application. When doing so, the same or different impregnating agents can be used.

Owing to the impregnation, the porosity of the abrasive support according to the invention is reduced to such an extent that coatings that are applied at a later point cannot penetrate the impregnated support material, or only to a minor extent. Moreover, the tear strength, flexibility and splitting strength can be modified and set by the selection of a suitable impregnation.

According to a further embodiment, the impregnating agent is introduced or applied in step (C) in the form of a polymer dispersion, a polymer solution, or mixtures thereof. Possible polymer dispersion are, e.g., aqueous dispersions of polymers selected from a group comprising acrylic acid esters, polyvinyl acetate, acrylonitrile butadiene rubber, acrylic acid ester styrene copolymers, ethylene vinyl acetate copolymers, styrene butadiene rubber, phenolic resin, epoxy resin, natural rubber, and combinations thereof. Suitable polymer solutions can be selected, e.g., from a group comprising polyvinyl alcohol in water, starch in water, melamine formaldehyde resin in water, urea formaldehyde resin, phenolic resins in methanol, epoxy resins in methanol, and combinations thereof.

Preferably, the resins used as impregnating agents have a weight-average molecular weight of at least 50000 g/mol, in particular at least 100000 g/mol, preferably at least 250000 g/mol, more preferably at least 500000 g/mol and particularly preferably at least 100000 g/mol. This makes it possible to efficiently close the pores of the support material such that the above-described advantageous air permeability and surface roughness of the impregnated surface roughness are obtained.

According to a further embodiment, a barrier coating layer is produced, in particular directly, on the impregnated support material in a further step (D). Preferably, the barrier coating is applied on the side of the impregnated support material, which has a surface roughness $R_z$ of 100 to 500 μm and an $R_{max}$ of 250 μm to 600 μm. Suitable methods for applying the barrier coating are, e.g., roll doctors, doctor blades, application by air brush or roller application.

The barrier coating can be, for example, by applying an aqueous dispersion on the basis of a material selected from a group comprising acrylic acid esters, polyvinyl acetate, acrylonitrile butadiene rubber, acrylic acid ester styrene copolymers, ethylene vinyl acetate copolymers, styrene butadiene rubber, phenolic resin, epoxy resin, natural rubber, and combinations thereof. If a dispersion is applied for the barrier coating, it is expedient to dry this, e.g. by heating in a kiln. The application amount after drying can be between 5 and 40 g/m$^2$, preferably between 5 and 30 g/m$^2$.

Both when introducing the impregnating agent (see step (C)) and when optionally producing a barrier coating (see step (D)), various additives and/or fillers can be added. Examples of additives are dyes, cross-linking agents, hydrophobizing agents, oleophobizing agents, hydrophilizing agents, or mixtures thereof. For instance, kaolin, titanium dioxide, talc, calcium carbonate, silicon dioxide, bentonite, or mixtures thereof can be used as fillers.

According to a further embodiment, the support is calendered in a further step (E). Accordingly, two or more calendering steps can be provided in the method.

Step (E) can be performed both with supports having a barrier coating layer and with supports having no a barrier coating layer. The inventors found that by step (E) the surface smoothness, this refers to possible roughenings such as scratches, but not or only insignificantly to the desired structures produced by calendering, and the flexibility of the support are increased. Preferably, the abrasive support is passed through the gap of a pair of rollers consisting of a steel roller and a rubber roller at a gap pressure of 30 to 300 N/mm, preferably 50 to 300 N/mm, during the calendering in step (E). The abrasive support is preferably fed to the calender used in such a manner that the side that is later to be sanded with an abrasive comes into contact with the steel roller. The calendering temperature is in particular between 20° C. and 80° C., preferably between 50° C. and 70° C.

Furthermore, a method for producing an abrasive article is stated as one aspect of the invention. This method comprises the steps according to at least one embodiment of the method described above for producing a support according to the invention.

According to at least one embodiment of the method, the support is sanded with an abrasive in a further step (F) on one side of the impregnated support material, which has a surface roughness $R_z$ of 100 μm to 500 μm and has an $R_{max}$ of 250 μm to 600 μm. The abrasive article according to the invention is thus obtained. The abrasive may, but does not have to be, produced directly on the impregnated support material. If there is a barrier coating, sanding with the abrasive is usually performed, in particular directly, on the barrier coating. Step (F) is expediently carried out after steps (A) to (C) and the optional steps (D) and/or (E).

According to a further embodiment, step (F) comprises the application of a base lacquer on the side of the impregnated support material having a surface roughness $R_z$ of 100 μm to 500 μm and having an $R_{max}$ of 250 μm to 600 μm, an application of the abrasive on the base lacquer and the production of a topcoat lacquer. Step (F), i.e. the "sanding" with an abrasive, may comprise or consist of the application of a base lacquer on the abrasive support according to the invention, the subsequent sprinkling or application of the abrasive, drying the base lacquer, applying a topcoat lacquer to the abrasive and drying the topcoat lacquer.

The base lacquer may be selected, for example, from epoxy resin, phenolic resin, alkyd resin, urea resin, or combinations thereof. The resins are preferably dispersed or dissolved in a suitable solvent and applied to the support. The abrasive is then sprinkled onto the base lacquer that is still wet, with it being possible to optimally align the individual particles or grains on the abrasive support according to the invention by electrostatic devices, for example. Following this, the abrasive support coated with the wet base lacquer and the abrasive adhering thereto is dried, e.g. in a drying kiln. Following drying, the abrasive or the support is coated with a topcoat lacquer. As a rule, a hard thermosetting resin, which additionally anchors the abrasive, is used as topcoat lacquer. The topcoat lacquer may be selected, for example, from epoxy resin, phenolic resin, alkyd resin, urea resin, or combinations thereof. This exemplary sanding is completed by curing the topcoat lacquer.

According to a further embodiment, a barrier coating layer is initially produced in step (D) on one side of the impregnated support material, which has a surface roughness $R_z$ of 100 μm to 500 μm and has an $R_{max}$ of 250 μm to 600 μm, and is then sanded with the abrasive in step (F). This is expedient since the barrier coating largely prevents a base lacquer from penetrating the support.

Using the method according to the invention, an advantageous support and thus an advantageous abrasive article can be produced. Therefore, a support is also provided which can be produced according to at least one embodiment of the method according to the invention. Furthermore, an abrasive article is provided which comprises such a support. The abrasive article may be produced by a method for producing abrasive articles according to at least one embodiment according to the invention.

Thus, the support may be produced by a method comprising the aforedescribed steps (A), (B) and (C) and optionally (D) and/or (E) according to the respective embodiments.

Preferably, the calendering in step (B) is configured as thermocalendering. Calendering in step (B) can be performed, for example, at a gap pressure of 30 to 300 N/mm, preferably 50 to 300 N/mm, and at a temperature between 80° C. and 280° C., preferably between 100° C. and 260° C. The structured rollers used in step (B) can have all of the conventional patterns, in particular embossing or engraving patterns, such as lines, ovals, rhombuses (lozenges), truncated cones and/or ellipses. The proportion of the compacted surface can in this case be 5% to 35%, preferably 10% to 30%, more preferably 15% to 28% and particularly preferably 20% to 27%.

Embodiment Example:

A spunbonded nonwoven of polyester fibers (continuous fibers) having an average fiber diameter of 18 μm was used as the support material. The diameter was determined by scanning microscope images. The support material had a grammage of 235 g/m$^2$, a thickness of 0.550 μm, an air permeability of 230 l/m$^2$ s, and a surface roughness $R_z$ of 178 μm on a smoother side and 369 μm on the opposite side. The surface roughness was achieved by thermocalendering of the support material with a line engraving roller.

Such a support material may be procured, for example, from the company Johns Manville, Bobingen (manufacturing no. 7536), under the designation T 478/235.

This spunbonded nonwoven was dip-impregnated with a styrene butadiene dispersion and dried. The proportion of the dried impregnating agent was 49% based on the non-impregnated nonwoven. The weight-average molecular weight of the impregnating resin was >1000000 g/mol. A barrier coating layer was then applied to the smoother side of the impregnated nonwoven using air brush application. The coating consisted of a mixture of styrene butadiene dispersion and acrylic acid ester styrene copolymer and was 18 g/m$^2$ after drying. Finally, the impregnated and coated spunbonded nonwoven was calendered between a steel roller and a rubber roller at 50° C. and a line pressure of 200 N/mm, with the side coated with the barrier coating facing the steel roller.

The thus produced abrasive support according to the invention had a grammage of 363 g/m$^2$, a thickness of 0.526 mm, an air permeability of 0 l/m$^2$ s, a breaking strength in dry condition and longitudinal direction of 301 N/15 mm, a breaking strength in dry condition and transverse direction of 238 N/15 mm, an elongation at break in dry condition and longitudinal direction of 37.0%, an elongation at break in dry condition and transverse direction of 43.7%, a bending stiffness in the longitudinal direction of 7.95 Nmm, a bending stiffness in the transverse direction of 5.1 Nmm, a tensile stiffness index in the longitudinal direction of 1.45 MNm/kg, a tensile stiffness index in the transverse direction of 1.03 MNm/kg, an elasticity modulus in the longitudinal direction of 983 MPa, an elasticity modulus in the transverse direction of 697 MPa, and on the side coated with the barrier coating a surface roughness $R_z$ of 84.1 μm and an $R_{max}$ of 97.2 μm.

Test Methods:

The grammage is determined according to DIN EN ISO 536.

The air permeability is determined according to DIN EN ISO 9237:1995 at a pressure difference of 200 Pa.

The thickness of a support or the support material is determined according to DIN EN ISO 534 at 20 N support pressure and a measuring surface of 200 mm$^2$.

The breaking strength in dry condition and in the longitudinal and transverse directions is determined according to DIN EN ISO 1924-2 with a ply width of 15 mm, a clamping length of 100 mm and a take-off speed of 150 mm/min.

The elongation at break in dry condition and in the longitudinal and transverse directions is determined according to DIN EN ISO 1924-2 with a ply width of 15 mm, a clamping length of 100 mm and a take-off speed of 150 mm/min.

The surface roughness is determined according to DIN EN ISO 4288:1997. Measurements were taken using a perthometer of the company Mahr, Gottingen, with the following settings:

Traversed length Lt=56 mm

Cutoff Lc=8 mm

Number of individual measurements (individual measurement lengths) N=5

Feed rate of the probing device: 0.5 mm/s

Profile filter Ls=25 μm

Vertical measurement range 250 μm

Probing device used: MFW-25 with 5 μm tip radius.

The $R_z$ value ascertained in a measurement is the arithmetic mean of the individual depths of roughness of all 5 individual measurement lengths, with an individual depth of roughness also being calculated according to DIN EN ISO 4287 (DIN EN ISO 4287:1998+AC:2008+A1:2009) from all of the measured values of an individual measurement length. The $R_{max}$ value is an individual value and refers to the greatest of the five individual depths of roughness.

The bending stiffness was determined according to DIN 53123, part 1.

The tensile stiffness was determined according to DIN ISO 1924-3 at an elongation rate of 150 mm/min.

The elasticity modulus was determined according to DIN ISO 1924-3 at an elongation rate of 150 mm/min.

The above-mentioned standards are used in the German version, the disclosures of which are thus incorporated by reference.

The invention claimed is:

1. A support for abrasives, comprising an impregnated support material based on synthetic fibers, wherein the impregnated support material has at least one side having a surface roughness $R_z$ of 100 μm to 500 μm and having an $R_{max}$ of 250 μm to 600 μm and the support has an air permeability of at most 20 l/m$^2$ s.

2. The support according to claim 1, wherein the synthetic fibers comprise synthetic continuous fibers or consist thereof.

3. The support according to claim 1, wherein the support material is a nonwoven.

4. The support according to claim 1, wherein the support material is evenly soaked with an impregnating agent.

5. The support according to claim 1, wherein the support material is impregnated with an impregnating agent on at least one side.

6. The support according to claim 1, wherein the surface roughness $R_z$ of 100 μm to 500 μm with an $R_{max}$ of 250 μm to 600 μm of the at least one side of the impregnated support material was produced by calendering with at least one structured roller.

7. The support according to claim 1, wherein the synthetic fibers comprise a polymer material selected from a group comprising polyethylene terephthalate, polybutylene terephthalate, polyethylene naphthalate, polybutylene naphthalate, polyamide, polyphenylene sulphide, polyolefin, polycarbonate, and combinations thereof.

8. The support according to claim 4, wherein the impregnating agent comprises a resin with a weight-average molecular weight of at least 50000 g/mol.

9. The support according to claim 1, wherein a barrier coating layer is produced on at least one side of the impregnated support material.

10. The support according to claim 9, wherein the barrier coating layer is arranged on one side of the impregnated support material, which has a surface roughness $R_z$ of 100 to 500 μm and has an $R_{max}$ of 250 μm to 600 μm.

11. The support according to claim 10, wherein the support on the side of the barrier coating layer, which faces away from the impregnated support material, has a surface roughness $R_z$ of 20 μm to 300 μm and has an $R_{max}$ of 50 μm to 400 μm.

12. The support according to claim 1, wherein the support has an elasticity modulus in the longitudinal and transverse directions of 100 to 10000 MPa.

13. The support according to claim 1, wherein the support has a tensile stiffness index of 0.3 to 10 MNm/kg in the longitudinal direction and of 0.2 to 10 MNm/kg in the transverse direction.

14. An abrasive article comprising a support according to claim 1, wherein the support is sanded with an abrasive on one side of the impregnated support material, which has a surface roughness $R_z$ of 100 μm to 500 μm and has an $R_{max}$ of 250 μm to 600 μm.

15. The abrasive article according to claim 14, wherein a barrier coating layer is produced on the impregnated support material and the support is sanded on the side of the barrier coating layer, which faces away from the impregnated support material.

16. A method for producing a support for abrasives, comprising the steps of:

(A) producing a support material based on synthetic fibers;

(B) calendering the support material with at least one structured roller so that the support material is structured on at least one side;

(C) impregnating the support material with an impregnating agent;

so that a support is obtained which comprises an impregnated support material based on synthetic fibers, which has at least one side having a surface roughness $R_z$ of 100 μm to 500 μm and having an $R_{max}$ of 250 μm to 600 μm, and which support has an air permeability of at most 20 $l/m^2$ s.

17. The method according to claim 16, wherein at least one barrier coating layer is produced on the impregnated support material in a further step (D).

18. The method according to claim 17, wherein the support is calendered in a further step (E).

19. The method for producing an abrasive article according to claim 16, wherein the support is sanded with an abrasive on one side of the impregnated support material, which has a surface roughness $R_z$ of 100 μm to 500 μm and has an $R_{max}$ of 250 μm to 600 μm, in a further step (F).

20. The abrasive article according to claim 14 wherein said abrasive article is an abrasive belt, abrasive disk or abrasive sheet.

21. The support according to claim 5, wherein the impregnating agent comprises a resin with a weight-average molecular weight of at least 50000 g/mol.

* * * * *